US009488014B2

(12) United States Patent
Sparkman et al.

(10) Patent No.: US 9,488,014 B2
(45) Date of Patent: Nov. 8, 2016

(54) BOX-ON-BOX SELF-STACKING SUBSTRUCTURE FOR A DRILL RIG

(71) Applicant: UNIT CORPORATION, Tulsa, OK (US)

(72) Inventors: Joseph Michael Sparkman, Norman, OK (US); Charles Vora, Bellaire, TX (US); Aaron Chang, Houston, TX (US)

(73) Assignee: Unit Corporation, Tulsa, OK (US)

( * ) Notice: Subject to any disclaimer, the term of this patent is extended or adjusted under 35 U.S.C. 154(b) by 0 days.

(21) Appl. No.: 14/537,171

(22) Filed: Nov. 10, 2014

(65) Prior Publication Data

US 2015/0143759 A1 May 28, 2015

Related U.S. Application Data

(60) Provisional application No. 61/908,453, filed on Nov. 25, 2013.

(51) Int. Cl.

| | |
|---|---|
| ***E04H 12/34*** | (2006.01) |
| ***E04H 12/18*** | (2006.01) |
| ***E21B 15/00*** | (2006.01) |

(52) U.S. Cl.

CPC ..... *E21B 15/00* (2013.01); *E21B 15/006* (2013.01); *E04H 12/18* (2013.01); *E04H 12/34* (2013.01); *E04H 12/344* (2013.01)

(58) Field of Classification Search

CPC ..... E21B 15/00; E21B 15/006; E21B 7/00; E04H 12/00; E04H 12/18; E04H 12/182; E04H 12/187; E04H 12/344; E04H 12/34

USPC ..... 52/112, 117, 118, 116, 122.1, 123.1, 52/126.1, 125.6

See application file for complete search history.

(56) References Cited

U.S. PATENT DOCUMENTS

| | | | |
|---|---|---|---|
| 2,204,671 | A | 6/1940 | Erickson et al. |
| 2,692,169 | A | 10/1954 | Phillips |
| 2,763,339 | A | 9/1956 | North |
| 3,000,473 | A | 9/1961 | Reynolds |
| 3,161,259 | A | 12/1964 | Wilson |
| 3,333,377 | A | 8/1967 | Woolslayer |
| 4,079,792 | A | 3/1978 | Paul et al. |
| 4,134,237 | A | 1/1979 | Armstrong |
| 4,590,720 | A | 5/1986 | Reed |
| 4,752,102 | A | 6/1988 | Rasmussen |
| 4,885,893 | A | 12/1989 | Wasterval, Jr. et al. |
| 5,181,693 | A | 1/1993 | Lorenz |

(Continued)

FOREIGN PATENT DOCUMENTS

| | | | |
|---|---|---|---|
| CN | 201778660 | U | 3/2011 |
| DE | 4226322 | C1 | 8/1992 |

(Continued)

*Primary Examiner* — Phi A

(74) *Attorney, Agent, or Firm* — McAfee & Taft, A Professional Corporation

(57) ABSTRACT

Disclosed is a drill rig having two master skids. Wherein prior to assembly of the drill rig, the master skids include a base box structure and a supported box structure arranged in a nested relationship. Additionally, the base box structures house hydraulic components and support components necessary to raise and support the supported box structure at an operational position. Further, the base box structures includes hydraulic components necessary to raise the drill rig mast to an operational position.

44 Claims, 13 Drawing Sheets

(56) References Cited

U.S. PATENT DOCUMENTS

| | | | | |
|---|---|---|---|---|
| 5,216,867 | A | 6/1993 | Wasterval, Jr. et al. | |
| 5,481,988 | A | 1/1996 | Dess | |
| 5,729,950 | A | 3/1998 | Hardy | |
| 7,195,102 | B2 | 3/2007 | Shai | |
| 7,823,337 | B2 | 11/2010 | Pope | |
| 7,828,086 | B2 | 11/2010 | Lesko | |
| 7,849,641 | B2 | 12/2010 | Johannsen | |
| 7,966,777 | B2 | 6/2011 | Douglas et al. | |
| 7,984,757 | B1 | 7/2011 | Keast et al. | |
| 8,047,303 | B2 | 11/2011 | Donnally et al. | |
| 8,555,564 | B2 * | 10/2013 | Wasterval | E21B 15/00 52/111 |
| 8,720,128 | B2 * | 5/2014 | Vogt | E21B 15/00 173/28 |
| 8,959,874 | B2 * | 2/2015 | Wasterval | E21B 7/021 52/117 |
| 8,997,435 | B2 | 4/2015 | Reddy et al. | |
| 9,091,126 | B2 | 7/2015 | Thiessen et al. | |
| 2003/0172599 | A1 | 9/2003 | Frink | |
| 2009/0200856 | A1 | 8/2009 | Chehade et al. | |
| 2011/0072737 | A1 * | 3/2011 | Wasterval | E21B 7/021 52/115 |
| 2011/0097180 | A1 | 4/2011 | Bastone | |
| 2011/0114386 | A1 | 5/2011 | Souchek | |
| 2011/0139043 | A1 | 6/2011 | Reed | |
| 2012/0167485 | A1 * | 7/2012 | Trevithick | E21B 15/00 52/112 |
| 2012/0298934 | A1 | 11/2012 | del Campo y Ruiz de Almodovar | |
| 2012/0304553 | A1 * | 12/2012 | Konduc | E21B 15/00 52/112 |
| 2013/0232887 | A1 | 9/2013 | Donnini | |
| 2013/0269268 | A1 * | 10/2013 | Thiessen | E21B 15/00 52/118 |
| 2014/0182232 | A1 | 7/2014 | Holt | |
| 2015/0300038 | A1 | 10/2015 | Thiessen et al. | |

FOREIGN PATENT DOCUMENTS

| | | | |
|---|---|---|---|
| FR | 2448620 | | 2/1979 |
| WO | WO0070159 | A1 | 11/2000 |
| WO | WO2009051522 | A1 | 4/2009 |

* cited by examiner

BOX-ON-BOX SELF-STACKING SUBSTRUCTURE FOR A DRILL RIG

CROSS RELATED

This application claims the benefit of previously filed U.S. Provisional Application Ser. No. 61/908,453 filed on Nov. 25, 2013.

BACKGROUND

Drill rigs are commonly used for a variety of well boring operations. The drill rig supports the primary equipment used during drilling operations. Common components include but are not limited to the derrick or mast, draw works, a rotary table, dog house, and driller's cabin. Drill rigs are commonly transported to the well site and assembled on location. To provide the desired operational height for the drill string and other components, the skids which provide the base or foundation of the rig are commonly multi-tiered.

Although various approaches have been used to achieve a stacked box arrangement of the skids, currently available designs require movement of a box structure onto the base skid using a crane. Alternatively, some designs utilize a scissors jack arrangement to lift a base platform from a lower position to an upper position. Each of the designs requires extra equipment for transportation to the drill site A drill rig configured such that the box structures are nested over or within one another would reduce transportation costs and improve safety during the assembly of the drill rig. Further, the additional incorporation of necessary hydraulic components into the box structures would provide further efficiencies to the overall operation thereby reducing costs.

SUMMARY

The present invention provides an improved drill rig. The drill rig comprises a first master skid and a second master skid. Each master skid includes a box structure and at least one supported box structure arranged in nested relationship. The first and second master skids are positioned a distance apart yet secured to one another. Each base box structure carries at least one hydraulic ram positioned to engage and lift the nested supported box structure from a first nested position to a second operational position. Each master skid carries at least one support point and at least one support pin. The support pin is moveable from a first position to a second position. When in the second position, the support pin is configured to engage a corresponding support point when said supported box structure is located at the second operational position thereby supporting the supported box structure in the operational position.

The present invention provides an improved drill rig. The drill rig comprises a first master skid and a second master skid. Each master skid includes a base box structure and at least one supported box structure. In the pre-assembly configuration, the supported box structure is configured to nest over or within the base box structure. During assembly of the drill rig, the first and second master skids are positioned a distance apart and secured to one another by bracing. Additionally, bracing secures the supported box structures to one another. Typically, the supported box structures carry a rig floor. The rig floor may extend from one supported box structure to another. Each base box structure carries at least one hydraulic ram suitable for engaging and lifting the supported box structure. Thus, the hydraulic ram provides the ability to lift the supported box structure from a first nested position to an operational position. Each master skid also carries at least two support pins. The support pins are moveable from a first position to a second position. Further, each master skid carries at least two support points. Each support point is configured for engagement by a support pin when the support pin is in the second position. Thus, cooperation between the support point and support pin retains the supported box structure in the operational position after the supported box structure has been lifted from the nested position to the operational position.

Still further, the present invention provides a method for raising a drill rig to an operational height. The method entails positioning first and second master skids a distance apart. Each master skid includes a box structure and at least one supported box structure arranged in nested relationship. Each base box structure carries at least one hydraulic ram positioned to engage and lift the nested supported box structure from a first nested position to a second operational position. Each master skid carries at least one support point and at least one support pin. The support pin is moveable from a first position to a second position. When in the second position, the support pin is configured to engage a corresponding support point when said supported box structure is located at the second operational position. Following positioning of the master skids, connecting or securing the skids to one another with bracing. Subsequently, the method actuates the hydraulic rams carried by each box structure thereby lifting the supported box structure. After lifting of the supported box structure, the moveable pins are moved from the first position to the second position and the position of the supported box structure is adjusted such that each support pin engages a support point thereby retaining the supported box structure at the desired operational height.

BRIEF DESCRIPTION OF THE DRAWINGS

FIG. 9 depicts a detailed view with the box structures of the master skids in the nested position and the mast in a raised position.

FIG. 16 depicts the nesting arrangement of the starter section of the mast and mast hydraulics within base box structure.

DETAILED DESCRIPTION

Figure 1:
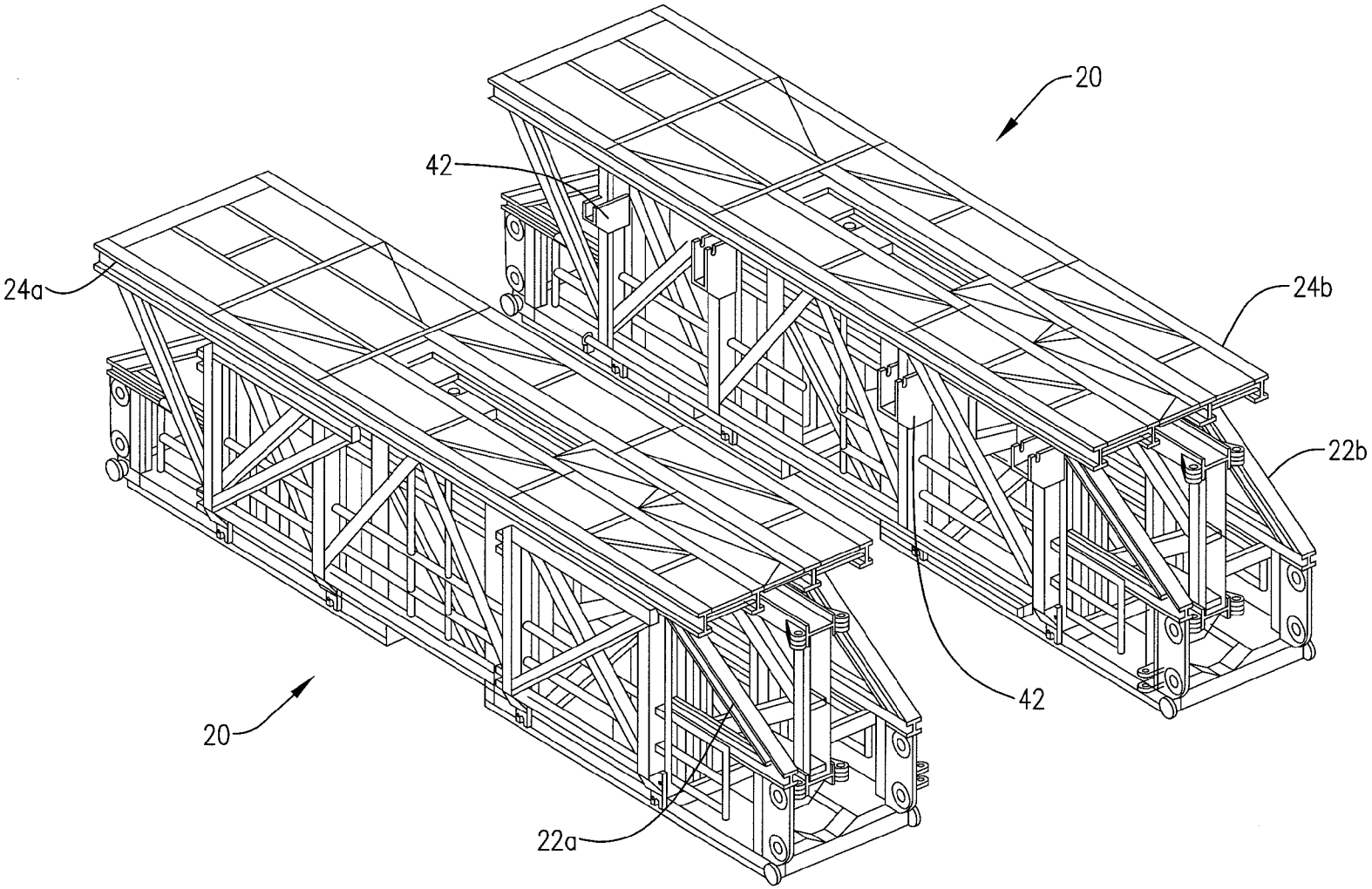
FIG. 1 depicts master skids.
Figure 2:
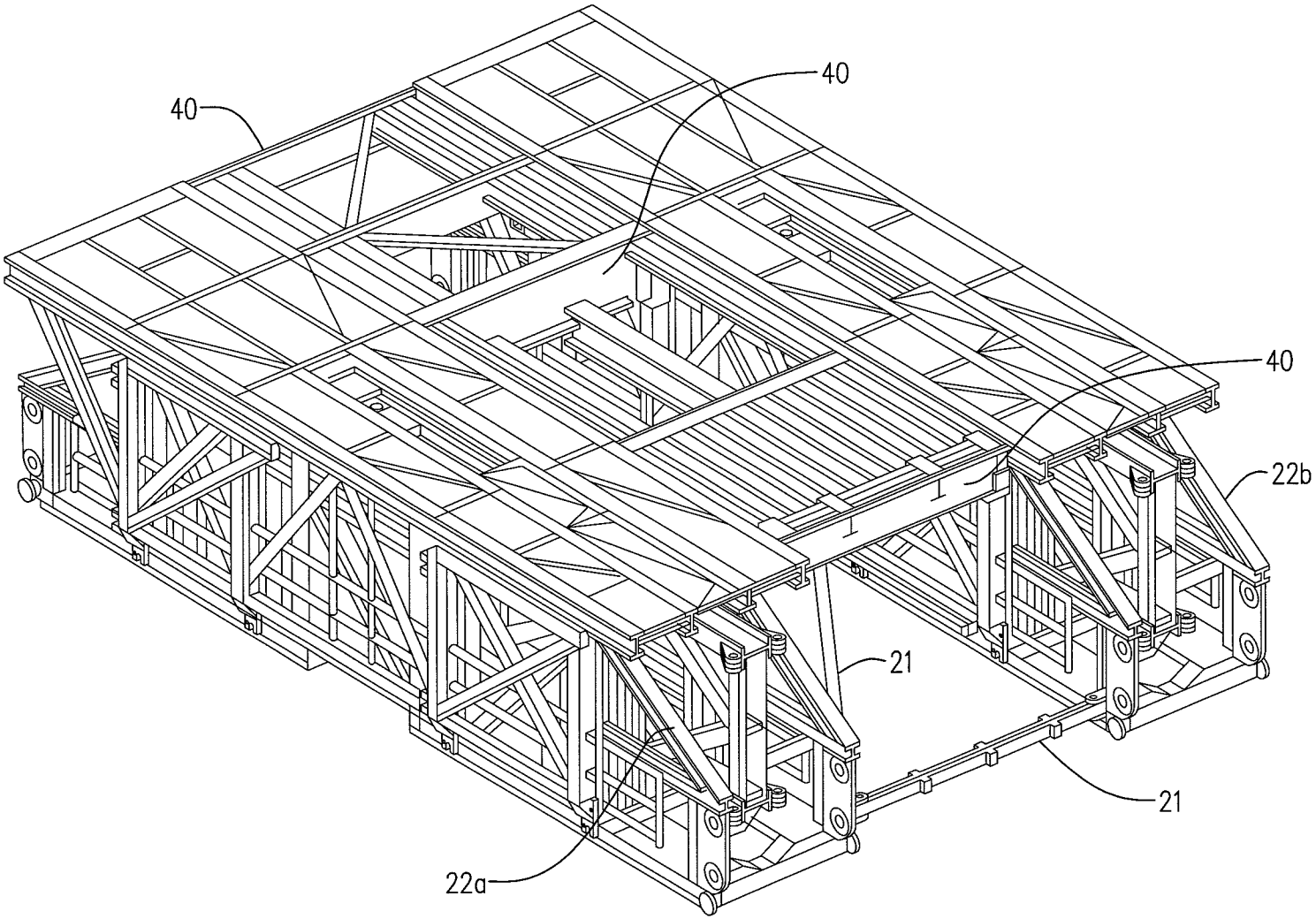
FIG. 2 depicts master skids with center steel or main spreader section installed.
Figure 3:
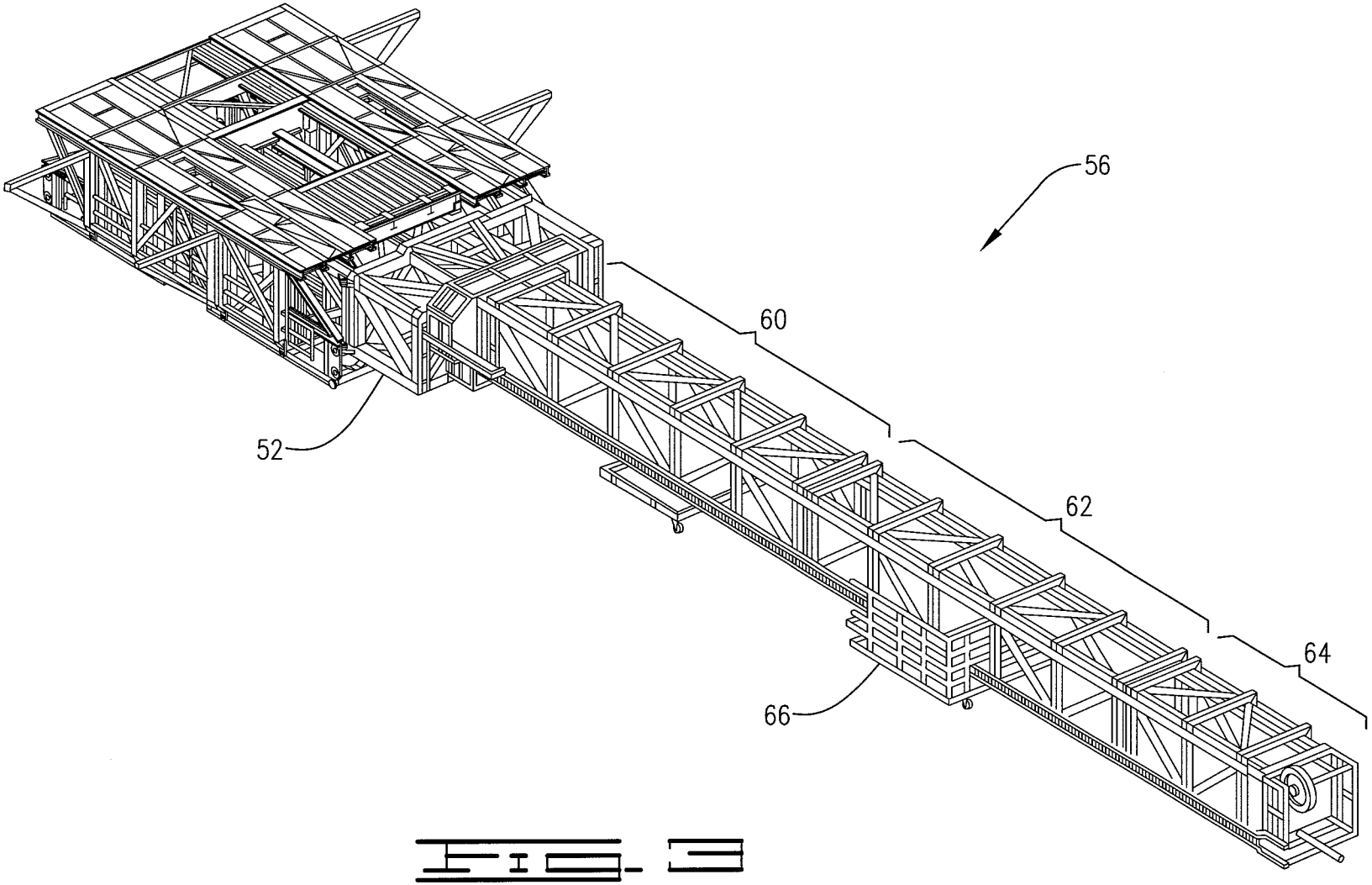
FIG. 3 depicts a partially configured drill rig with mast sections secured to the starter mast portion.
Figure 4:
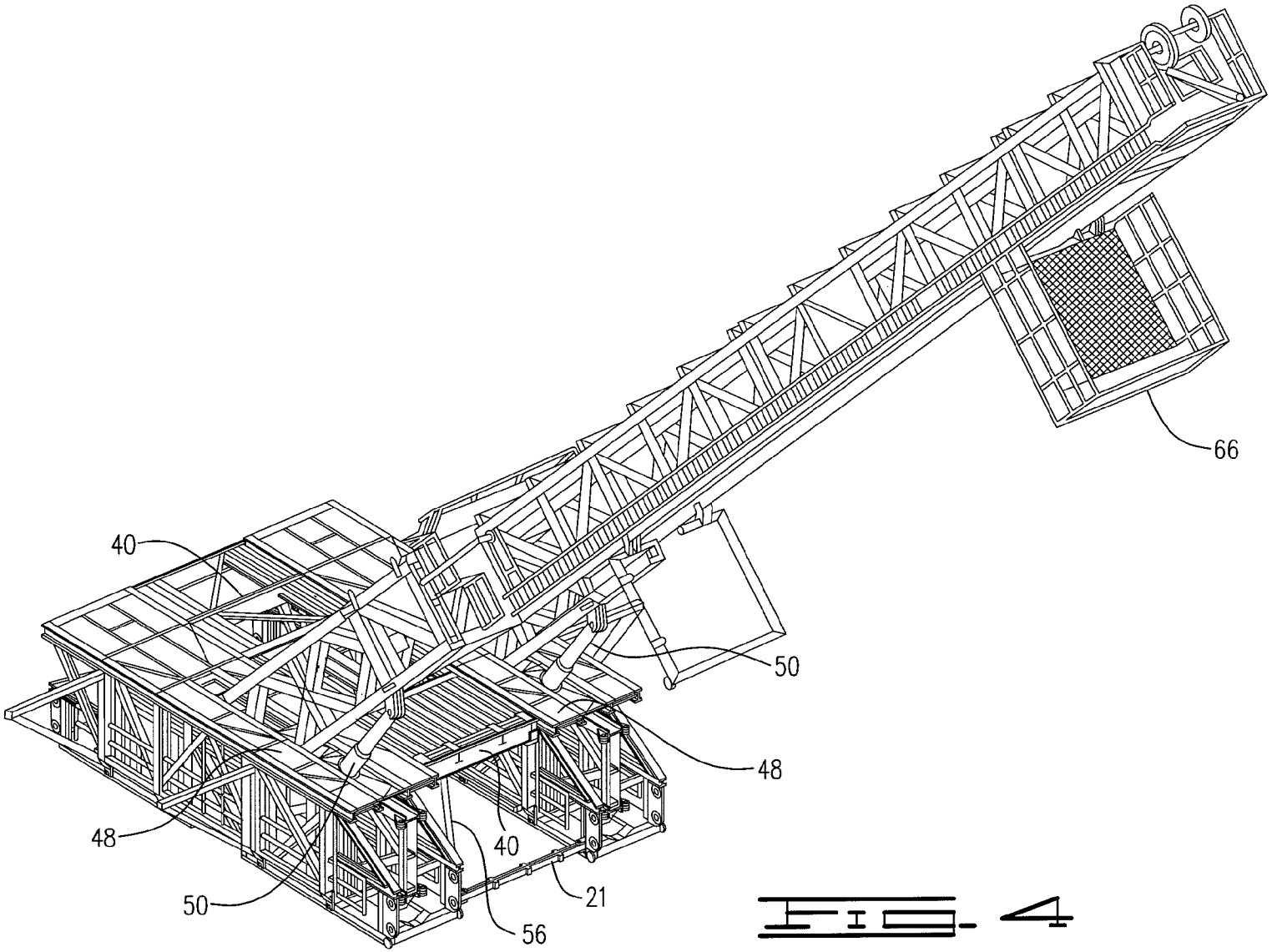
FIG. 4 depicts a partially configured drill rig with a partially raised mast.
Figure 5:
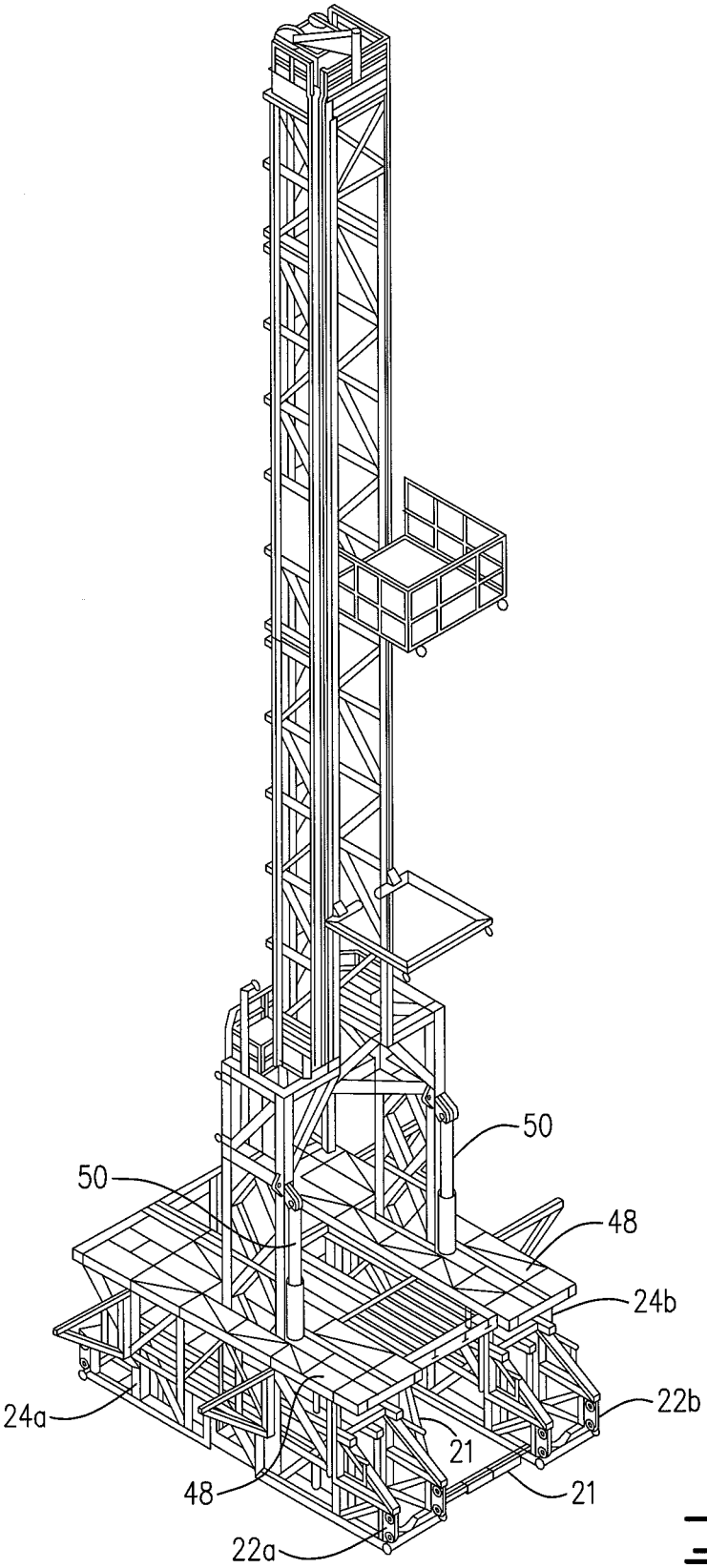
FIG. 5 depicts a partially configured drill rig with supported box sections partially raised from the nested position.
Figure 6:
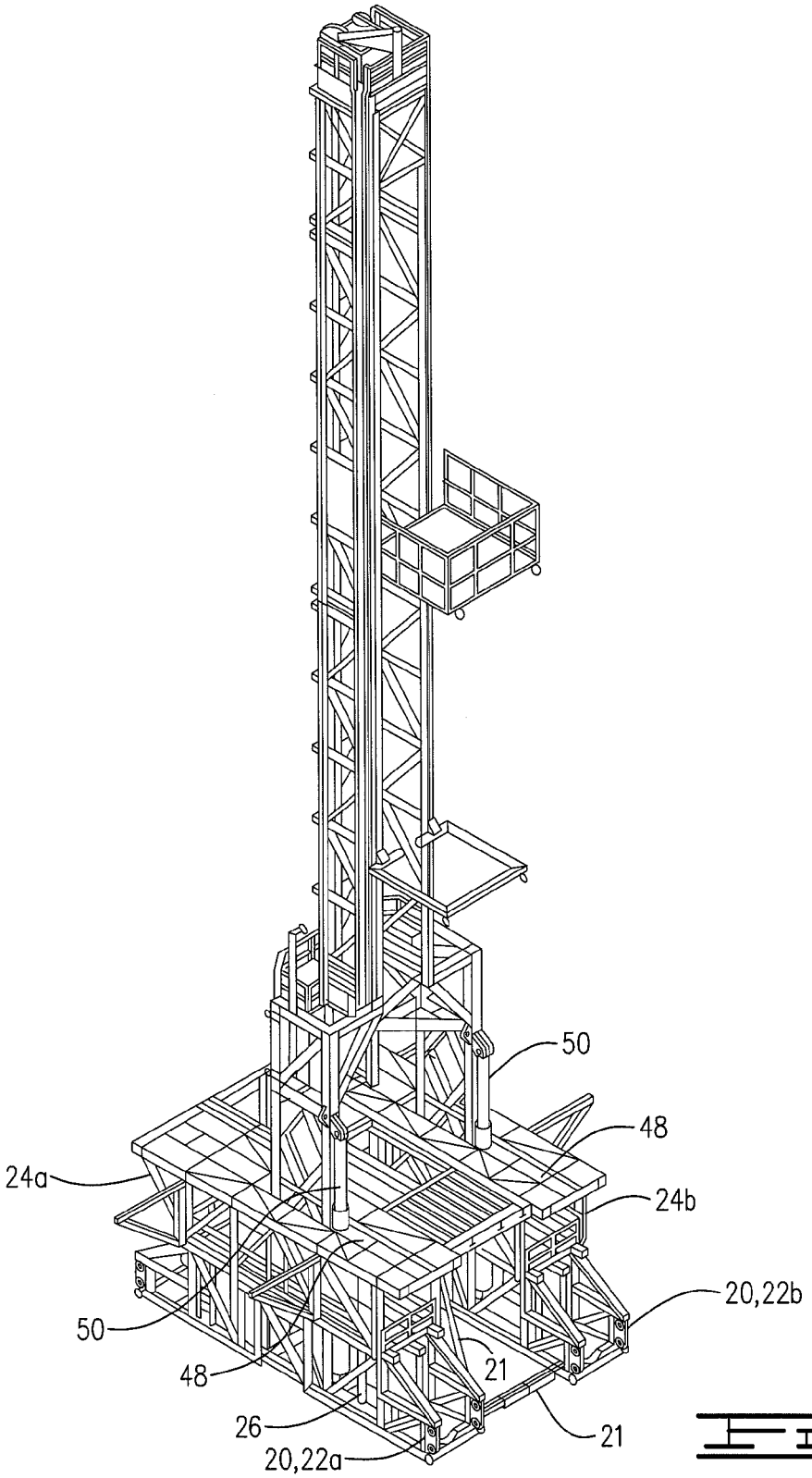
FIG. 6 depicts a partially configured drill rig with supported box sections fully raised from the nested position.

The current invention provides an improved drill rig configuration and method for assembling a drill rig. Turning first to the improved configuration, the new drill rig configuration provides improved transportation efficiency to the drill site, quicker assembly and enhanced stability of the assembled drill rig. In particular, the improved drill rig eliminates the potential for the failure of the scissors type hydraulic lifts currently used to lift a platform to an operational height or the hazards of stacking substructure boxes with a crane. Additionally, the improved drill rig provides a compact structure for transportation to the drill site. Thus, two master skids contain all the support elements necessary to configure a drill rig. The lower legs of the mast are also contained in the master skid assembly for transportation.

With reference to the drawings, the drill rig 10 of the present invention utilizes two master skids 20. Each master skid 20 has a base box structure 22 arranged in a nested relationship with a supported box structure 24. As used herein the term "box structure" refers to the box-like configuration of beams, supports and braces defining the base structure and supported structure. Additionally, each master skid includes the starter mast section 52 of mast 56 as well as the mast hydraulics 50 used to raise starter mast 52 and mast 56. Although the base box structure 22 is depicted in the FIGS. as nested inside of supported box structure 24, supported box structure 24 may be nested within base box structure 22.

Base box structure 22 includes least one, more typically at least two hydraulic rams 26. Additionally, each base box structure 22 carries at least two, more typically, multiple support pins 28. Support pins 28 are movable from a first retracted position to a second position. In the retracted position, pins 28 permit movement of supported box structure 24 from the nested position to the operational position. Additionally, each base box structure 22 carries at least one and preferably a plurality of glides or slide pads 44. Slide pads 44 are bolted, welded or otherwise secured to inner and outer vertical components of base structures 22. Slide pads 44 maintain alignment of supported box structures 24 relative to base box structures 22 during lifting operations. As an alternative to slide pads, roller assemblies may be used. K-braces 21 or other similar bracing structures secure base box structures 22*a* and 22*b* to one another thereby assuring the correct spacing between master skids 20.

Figure 7:
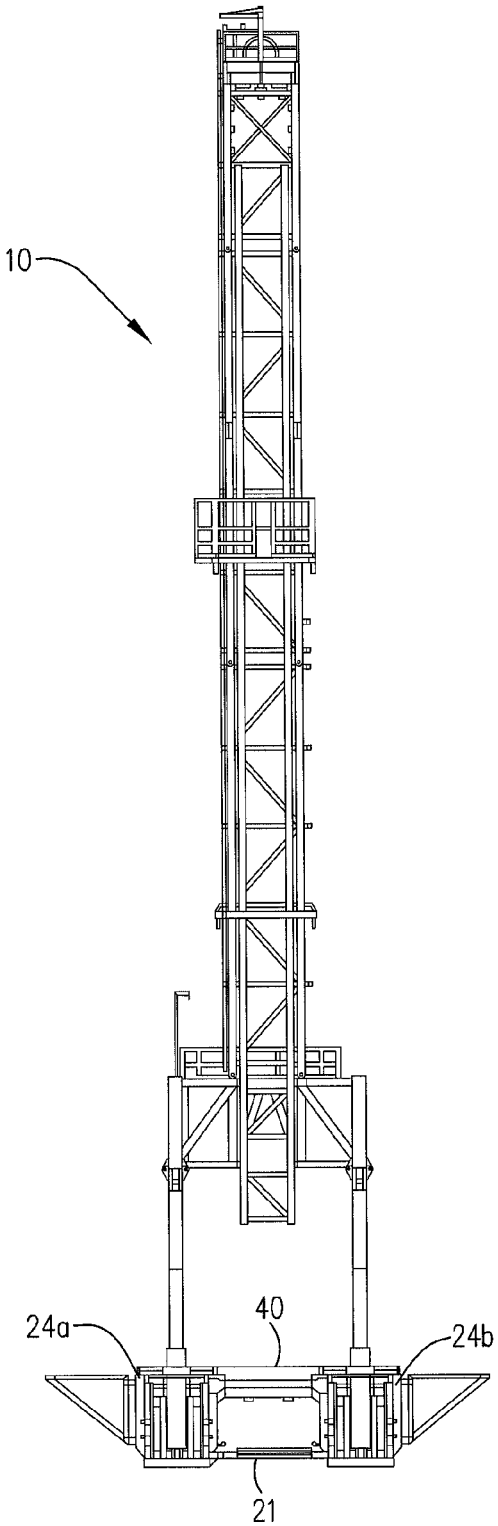
FIG. 7 depicts a front view of a partially configured drill rig.
Figure 8:
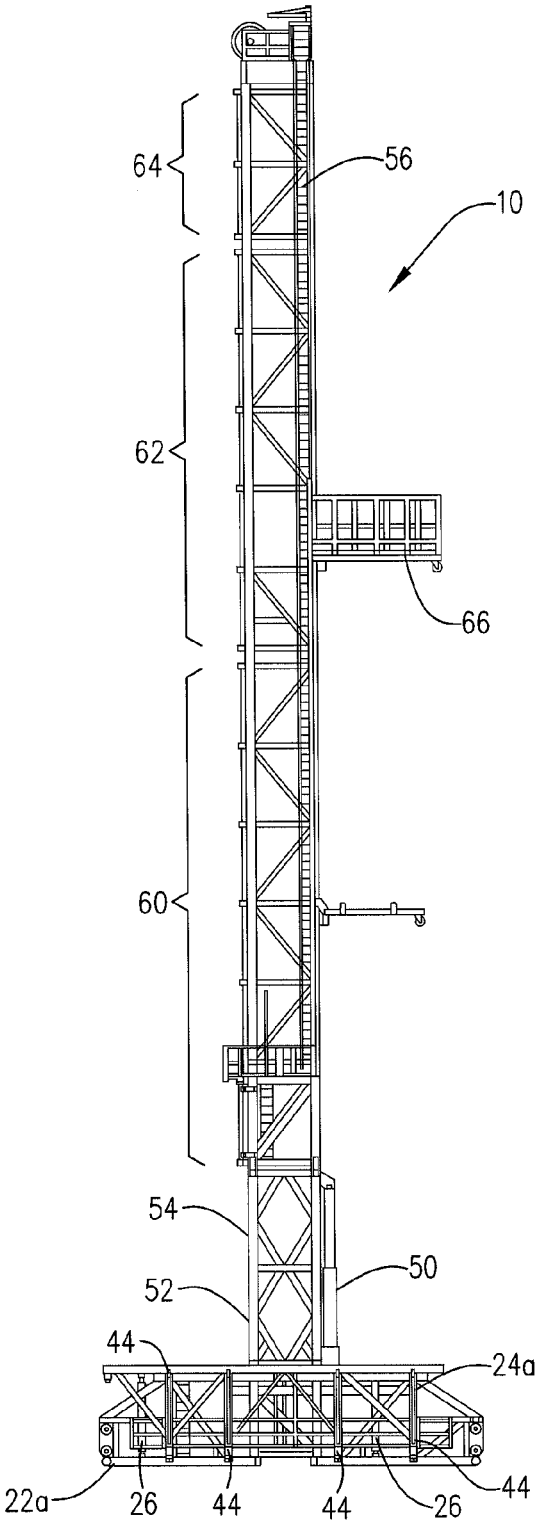
FIG. 8 depicts a side view of a partially configured drill rig.
Figure 5:
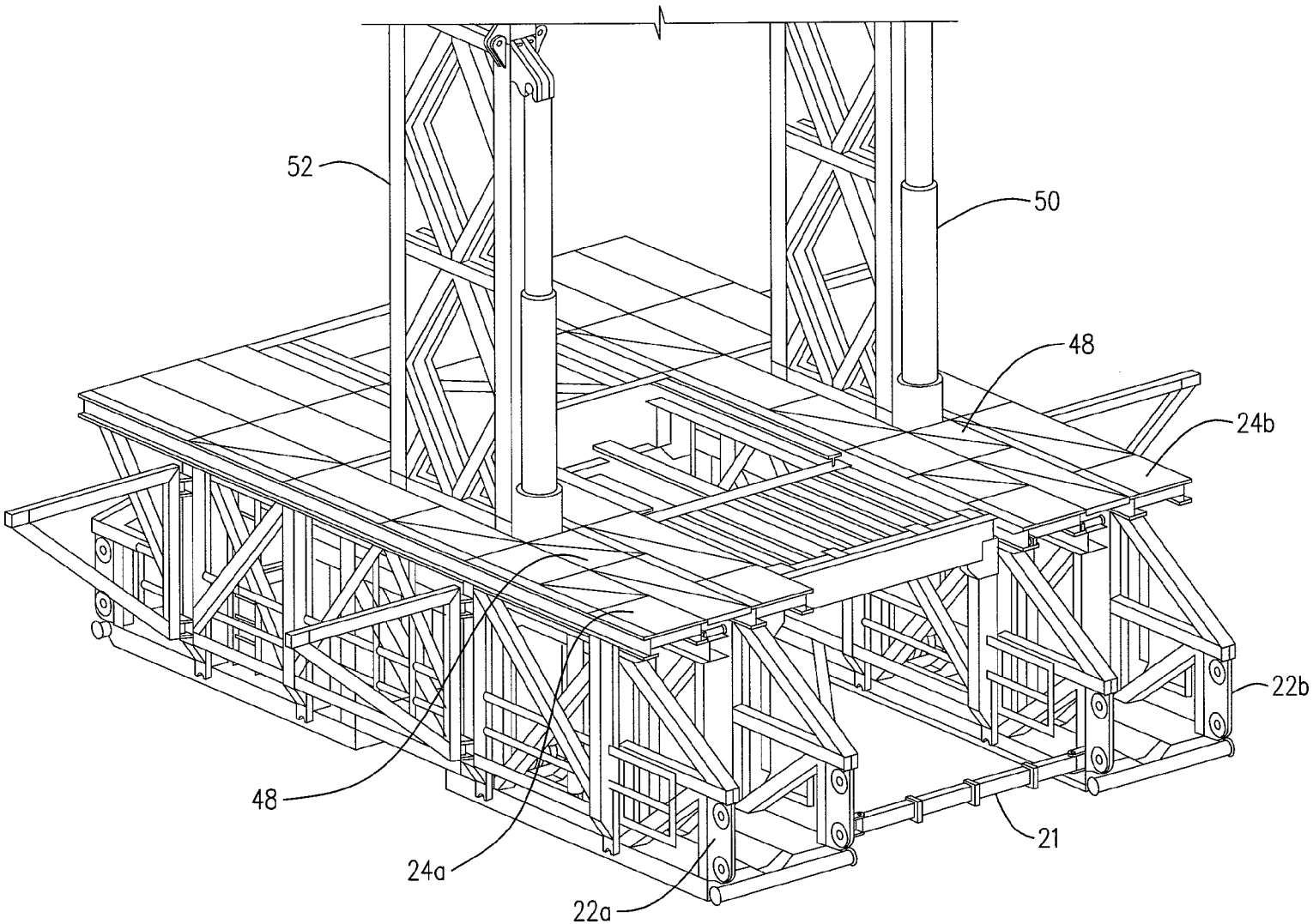
Figure 10:
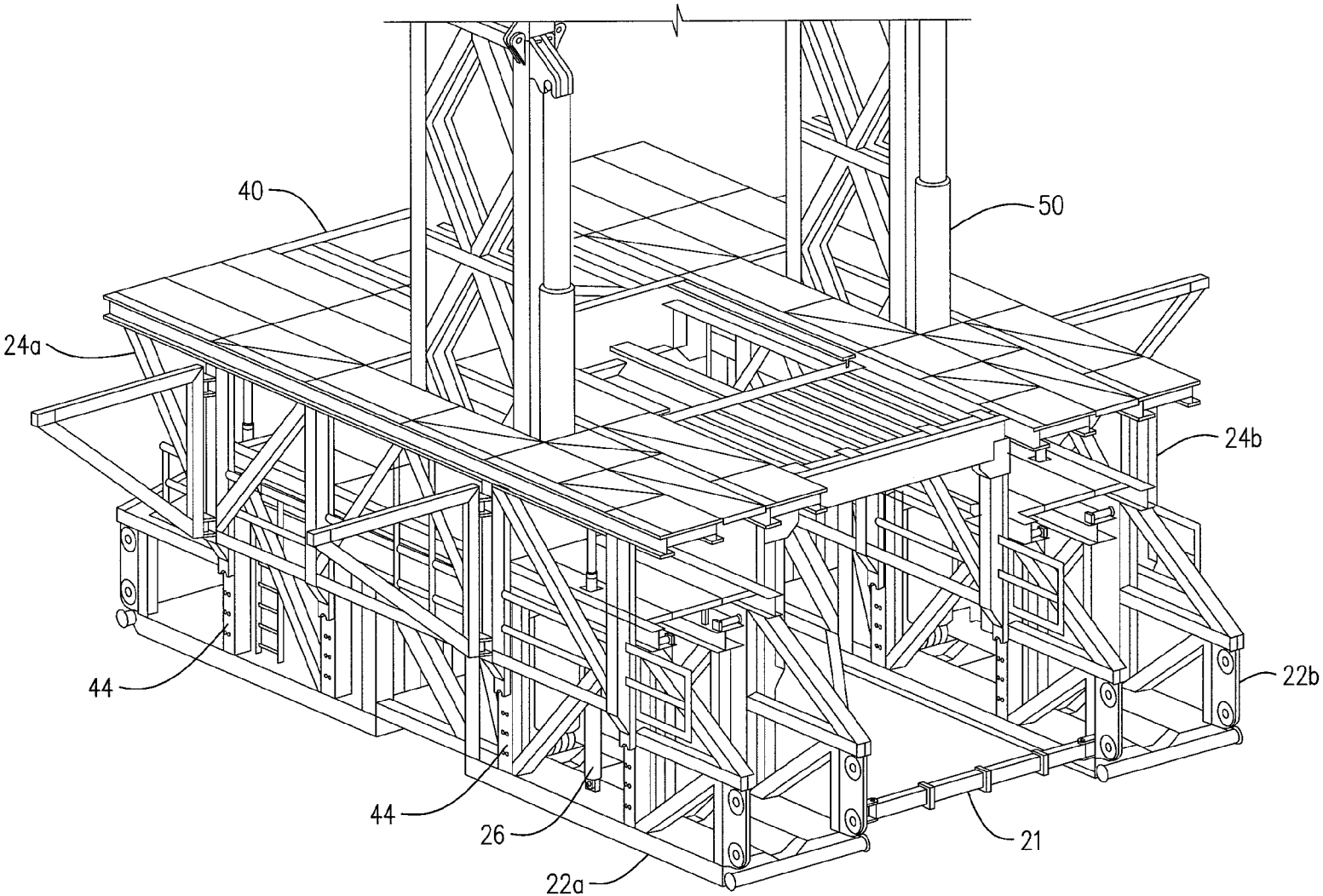
FIG. 10 depicts a detailed view with the box structures of the master skids in a partially raised position and the mast in a raised position.
Figure 13:
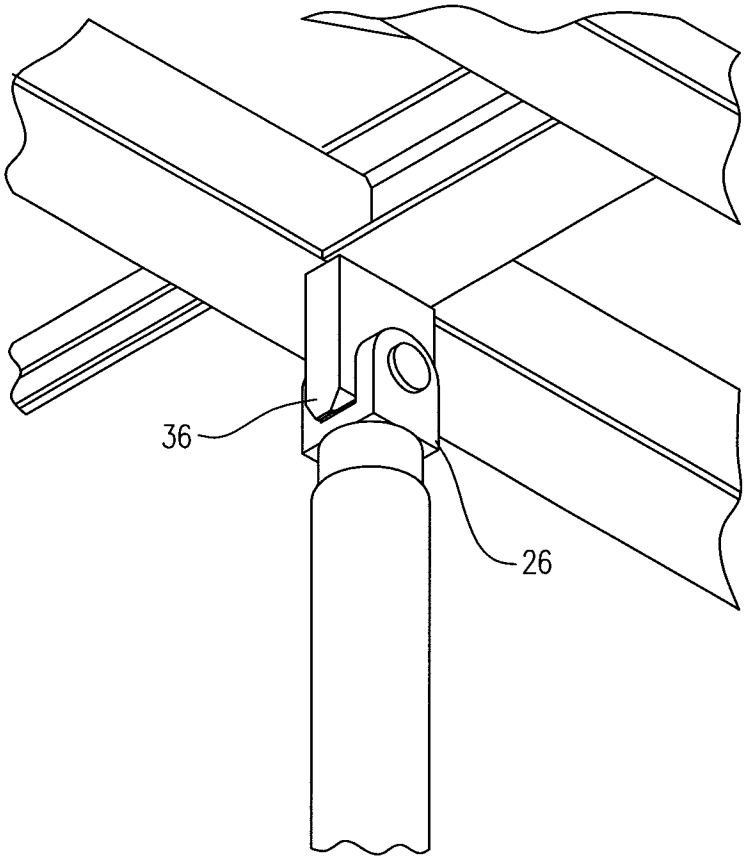
FIG. 13 depicts the upper end of a hydraulic ram carried by a base box structure in engagement with a contact point on a supported box structure.

As depicted in FIG. 7, base box structure 22*a* would be referred to by those skilled in the art as the driller's side base box structure and base box structure 22*b* would be referred to as the off-driller's side base box structure. Typically, driller's side and off-driller's side determine where other components such as the driller's cabin (not shown) and dog-house (not shown) will be located. Finally, each base box structure 22*a*, 22*b* houses the mast hydraulics 50 and the starter sections 52 of mast 56. As depicted in FIG. 13, starter sections 52 and mast hydraulics 50 are housed or nested in a generally horizontal position within base box structures 22*a* and 22*b*.

Supported box structures 24*a* and 24*b* provide the structural support for the floor 46 of drill rig 10. Floor 46 includes hinged doors 48. Additionally, other components such as but not limited to the drawworks, drill line anchor, drill line spool, drill line spooler, rotary table, pipe handling equipment and racking board (not shown) will be secured to and carried by supported box structures 24*a* and 24*b*. Each supported box structure 24 carries at least one contact point 36. During lifting of supported box structures 24*a* and 24*b*, each hydraulic ram 26 engages contact point 36 on each supported box structure 24*a* and 24*b*. Additionally, each supported box structure 24 carries at least two support points 38. Each support point 38 is configured to engage support pins 28. Support points 38 may be in the form of a flange configured to receive and rest upon support pin 28 or may be a hole through which support pin 28 passes when pin 28 is moved from the retracted position to the extended position. Other configurations of support point 38 may include but are not limited to saddles, pin pockets or slots.

The present invention also provides an efficient method for assembling a drill rig. The following discussion will focus on the positioning and assembly of the master skids 20 that form the base of drill rig 10. Assembly and installation of the upper rig components such as the dog-house 34 and driller's cabin 32 will be carried out in a conventional manner known to those skilled in the art.

According to the method of the present invention, first and second master skids 20, as described above, are positioned the desired distance apart and joined by braces such as k-braces 21 or other suitable braces. Those skilled in the art are familiar with the use of k-braces 21 to stabilize master skids 20. Subsequently, supported box structures 24*a,b* are secured to one another by installation of center steel components 40. Center steel components 40 are secured to or rest on center steel support points 42. Thereafter, rig floor 46 will be installed in a manner known to those skilled in the art.

In general, those conventional top rig components familiar to those skilled in the art will be installed prior to lifting supported box structures 24*a,b* to the desired operational position. For example, following installation of center steel 40 and rig floor 46, dog-house 34 and driller's cabin 32 are installed. Subsequently, mast components necessary for formation of mast 56 are joined to starter section 52. Such mast components, as known to those skilled in the art, include a strong back section, also known as a transition piece 58, and lower stem 60, middle stem 62 and upper stem 64 all of which form mast 56. Following assembly of these components, hinged doors 48 are opened and mast hydraulics 50 actuated to begin movement of the assembled mast from a horizontal position to an upright operational position. Generally, movement is halted in order to install a finger board 66.

Once raised to an operational position, mast 56 will be pinned in place in a manner known to those skilled in the art. Subsequently, mast hydraulics 50 are retracted and stored in base boxes 22*a*, 22*b*.

Figure 11:
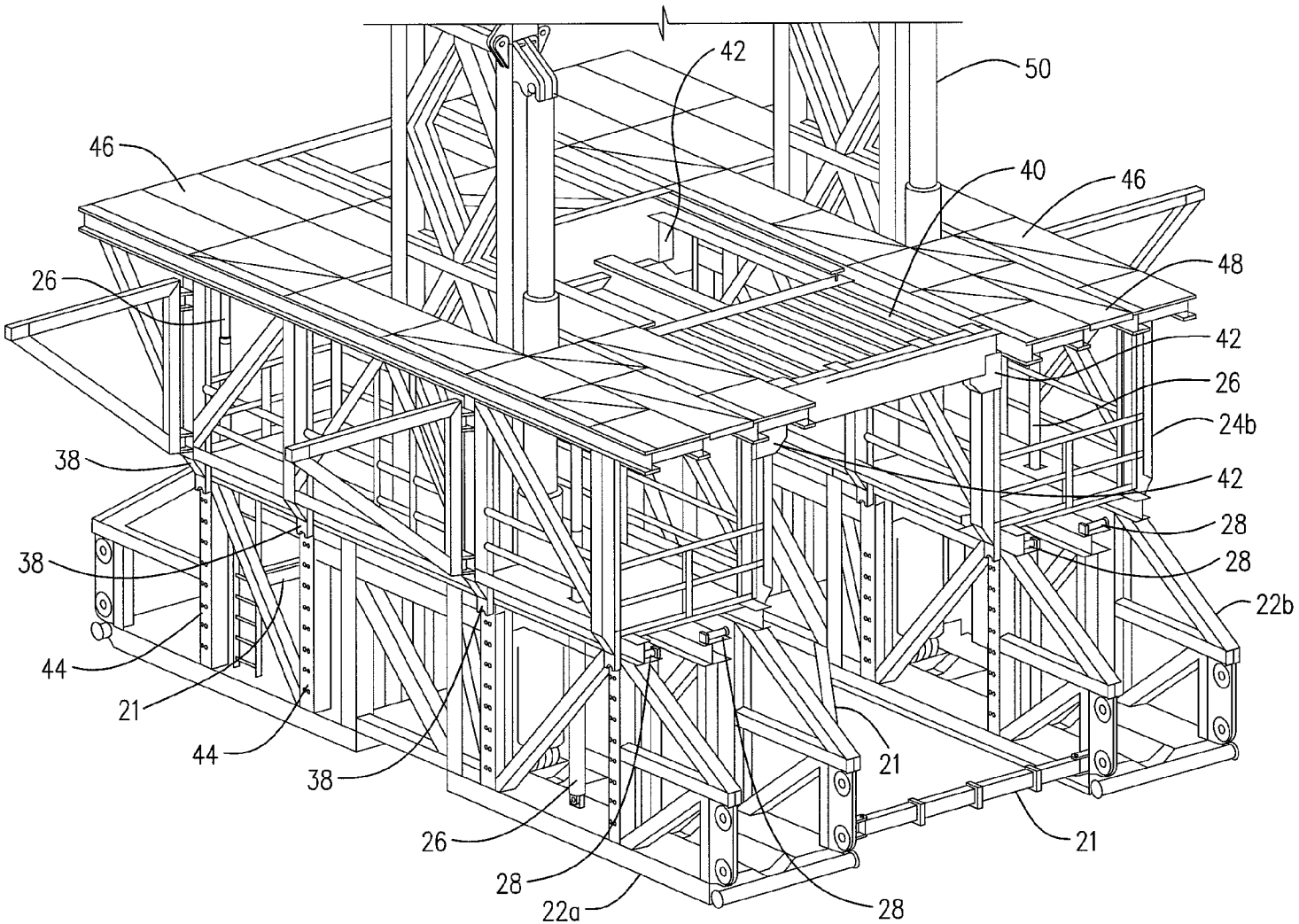
FIG. 11 depicts a detailed view with the box structures of the master skids in a fully raised position and the mast in a raised position.
Figure 12:
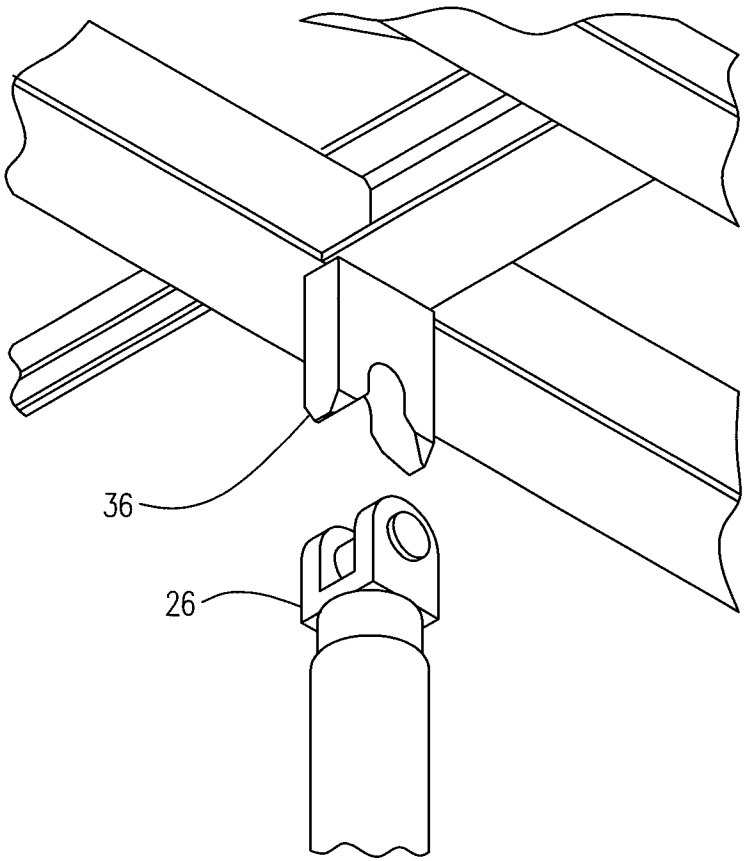
FIG. 12 depicts the upper end of a hydraulic ram carried by a base box structure in relation to a contact point on a supported box structure.
Figure 15:
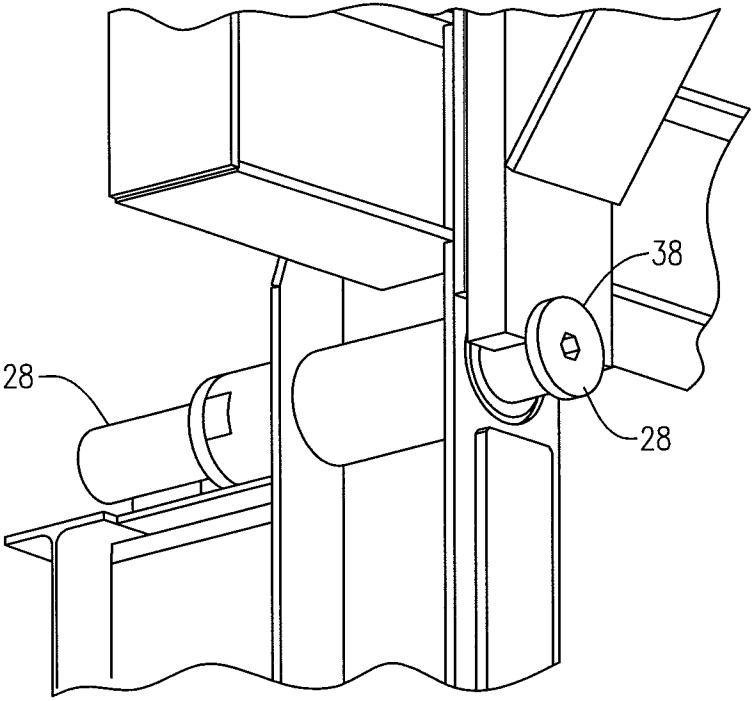
FIG. 15 depicts the engagement of a support point on a supported box structure with an extended support pin carried by a base box structure.
Figure 14:
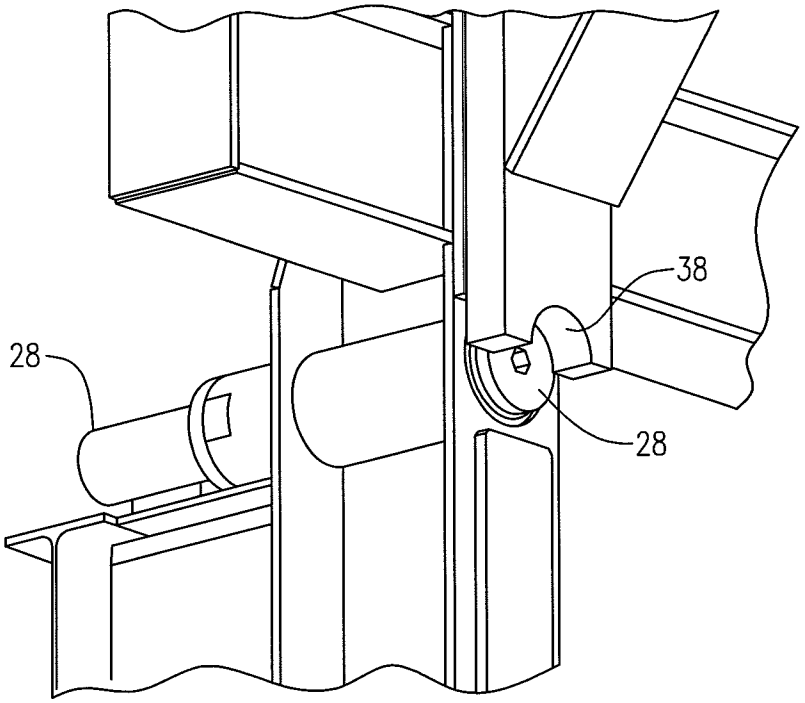
FIG. 14 depicts the alignment of a support point on a supported box structure with a retracted support pin carried by a base box structure.
Figure 15:
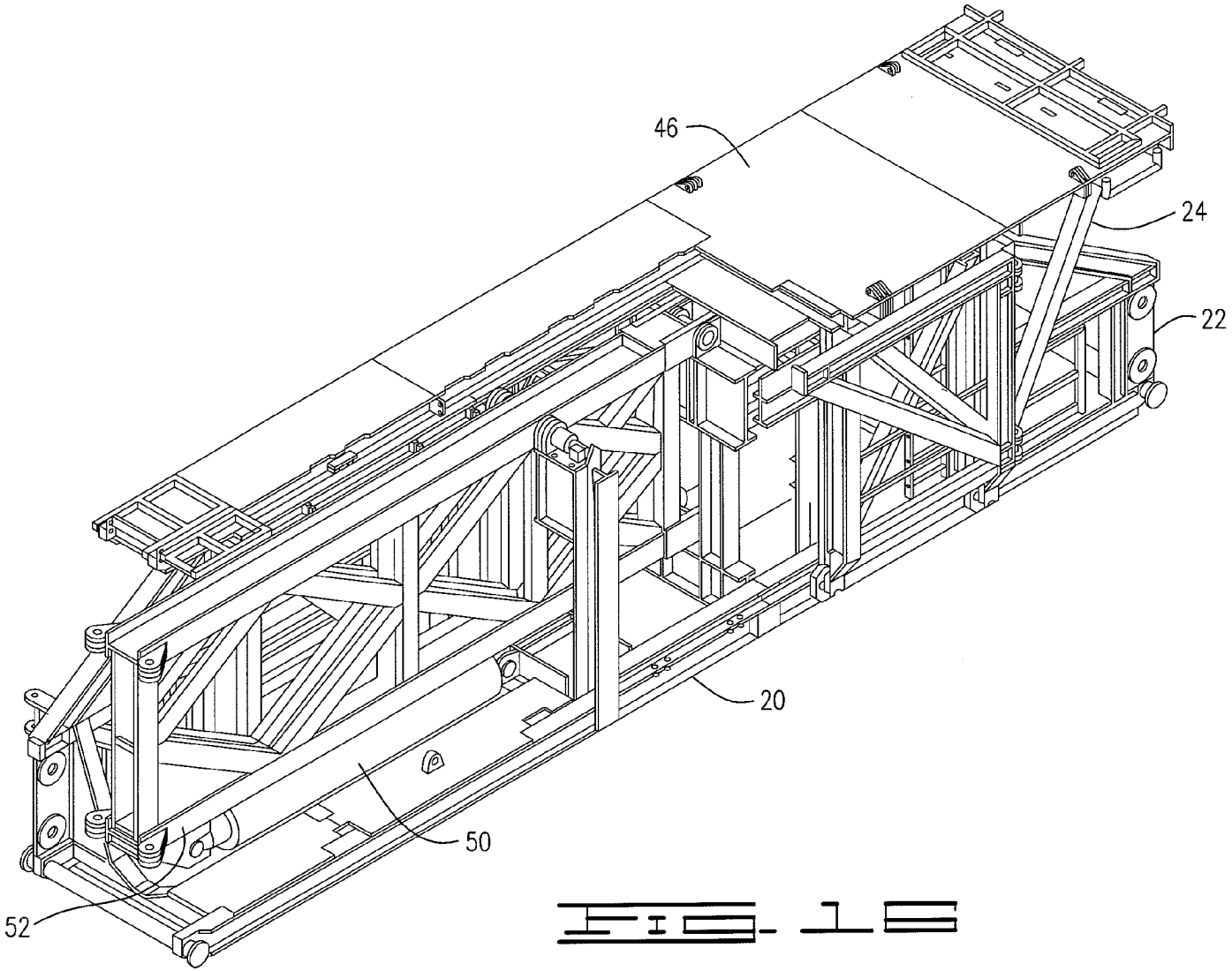

Following installation and configuration of the upper rig components, the rig operator will initiate lifting of supported box structures 24*a,b* to the desired operational position. As discussed above, each base box structure 22 carries at least one hydraulic ram 26. As depicted, each box structure 22 of the current invention utilizes two hydraulic rams 26. The hydraulic rams are powered by a conventional hydraulic system. As depicted in FIGS. 11-13 a first end 26*a* of ram 26 is secured to base box structure 22 while the other end 26*b* engages contact point 36 on supported box structure 24. Actuation of all hydraulically rams 26 occurs simultaneously in order to raise supported box structures 24*a* and 24*b* while maintaining a substantially level rig floor 34.

Depending upon the configuration of support points 38, upward movement of supported box structures 24*a* and 24*b* continues until support points 38 are positioned above or adjacent to movable pins 28. If support points 38 are flanges or other similar configurations, then movement continues until flanges 38 are positioned above movable pins 28. Movable pins 28 are then extended and hydraulic rams 26 actuated to lower supported box structures 24 to a resting position on pins 28 such that pins 28 contact support points 38. If support points 38 are holes passing through a frame member of supported box structures 24*a* and 24*b*, then movement of supported box structures 24*a* and 24*b* will stop when support points 38 are aligned with movable pins 28. In either case, following positioning of pins 28, hydraulic rams 26 may be retracted into a storage area of each base box structure 22*a* and 22*b* thereby allowing the mass of each supported box structure 24*a* and 24*b* to rest on movable pins 28 of each base box structure 22*a* and 22*b*. The remainder of the rig assembly process continues in accordance with conventional assembly methods.

Other embodiments of the present invention will be apparent to one skilled in the art. For example, the foregoing discussion describes the location of support pins 28 and hydraulic rams 26 as carried by base box structures 22 and support points 38 and contact points 36 as carried by supported box structures 24. However, the present invention also contemplates reversal of this configuration. Thus, supported box structures 24 may carry support pins 28 and hydraulic rams 26 while base box structure 22 carries support points 38 and contact points 36. Thus, when actuated hydraulic rams 26 will engage contact points on base box structure 22 driving the supported box structure to the desired elevation without degrading performance of drill rig 10. Similarly, following positioning of supported box structures 24, moveable support pins 28 will be extended and supported box structure subsequently supported by support point 38. Regardless of the location of these components, the method for positioning and raising drill rig 10 will be essentially the same. Therefore, the foregoing description merely enables and describes the general uses and methods of the present invention. Accordingly, the following claims define the true scope of the present invention.

What is claimed is:

1. A drill rig comprising:

a first master skid and a second master skid, each master skid comprising a base box structure and at least one supported box structure, in a pre-assembly configuration said base box structure and said supported box structure are arranged in a nested relationship;

said first and second master skids positioned a distance apart and secured to one another;

at least one hydraulic ram carried by each base box structure, said hydraulic ram positioned to engage said supported box structure, said hydraulic ram configured to lift said supported box structure from said nested position to an operational position;

at least one support pin carried by each master skid, said support pin moveable from a first position to a second position; and, at least one support point carried by each master skid, whereby each support pin is configured to engage said support point when said support pin is in the second position, engagement of said support point by said support pin retains said supported box structures in the operational position after said supported box structures has been lifted to the operational position.

2. The drill rig of claim 1, wherein said supported box structure is nested over said base box structure.

3. The drill rig of claim 1, wherein said supported box structure nests within said base box structure.

4. The drill rig of claim 1, wherein each base box structure carries at least one support pin and each supported box structure carries at least one support point.

5. The drill rig of claim 1, wherein each base box structure carries at least one support point and each supported box structure carries at least one support pin.

6. The drill rig of claim 1, wherein each base structure carries at least two support pins and each supported box structure carries at least two support points.

7. The drill rig of claim 1, wherein each base structure carries at least two support points and each supported box structure carries at least two support pins.

8. The drill rig of claim 1, wherein each base structure carries at least two hydraulic rams.

9. The drill rig of claim 1, wherein each supported box structure has at least two contact points configured for engagement by said hydraulic rams carried by said base structure.

10. The drill rig of claim 1, wherein each supported box structure carries at least two hydraulic rams and each base box structure has at least two contact points configured for engagement by said hydraulic rams.

11. The drill rig of claim 1, wherein each base box structure has at least one slide pad.

12. The drill rig of claim 1, further comprising a starter section of a mast.

13. The drill rig of claim 1, wherein said a portion of said starter section of a mast is nested within each base box structure.

14. The drill rig of claim 1, further comprising mast hydraulics initially carried within said base box structure, said mast hydraulics suitable for raising a mast supported by said drill rig to an operational position.

15. A drill rig comprising:

a first master skid and a second master skid, each master skid comprising a base box structure and at least one supported box structure, in a pre-assembly configuration said supported box structure is arranged in a nested relationship over said base box structure;

said first and second master skids positioned a distance apart and secured to one another;

at least two hydraulic rams carried by each base box structure, each hydraulic ram positioned to engage a contact point carried by said supported box structure, said hydraulic rams configured to lift said supported box structure from said nested position to an operational position;

at least one support pin carried by each master skid, said support pin moveable from a first position to a second position; and, at least one support point carried by each master skid, whereby each support pin is configured to engage said support point when said support pin is in the second position, engagement of said support point by said support pin retains said supported box structures in the operational position after said supported box structures has been lifted to the operational position.

16. The drill rig of claim 15, wherein each base box structure carries at least one support pin and each supported box structure carries at least one support point.

17. The drill rig of claim 15, wherein each base box structure carries at least one support point and each supported box structure carries at least one support pin.

18. The drill rig of claim 15, wherein each base structure carries at least two support pins and each supported box structure carries at least two support points.

19. The drill rig of claim 15, wherein each base structure carries at least two support points and each supported box structure carries at least two support pins.

20. The drill rig of claim 15, wherein each base box structure has at least one slide pad.

21. The drill rig of claim 15, further comprising a starter section of a mast.

22. The drill rig of claim 15, wherein said a portion of said starter section of a mast is nested within each base box structure.

23. The drill rig of claim 15, further comprising mast hydraulics initially carried within said base box structure, said mast hydraulics suitable for raising a mast supported by said drill rig to an operational position.

24. A drill rig comprising:

a first master skid and a second master skid, each master skid comprising a base box structure and at least one supported box structure, in a pre-assembly configuration said base box structure and said supported box structure are arranged in a nested relationship;

said first and second master skids positioned a distance apart and secured to one another;

at least one hydraulic ram carried by each base box structure, said hydraulic ram positioned to engage said supported box structure, said hydraulic ram configured to lift said supported box structure from said nested position to an operational position;

at least one support pin carried by each master skid, said support pin moveable from a first position to a second position;

at least one support point carried by each master skid, whereby each support pin is configured to engage said support point when said support pin is in the second position, engagement of said support point by said support pin retains said supported box structures in the operational position after said supported box structures has been lifted to the operational position;

a starter section of a mast wherein at least a portion of said starter section of a mast is nested within each base box structure; and mast hydraulics initially carried within said base box structure, said mast hydraulics suitable for raising a mast supported by said drill rig to an operational position.

25. The drill rig of claim 24, wherein said supported box structure is nested over said base box structure.

26. The drill rig of claim 24, wherein said supported box structure nests within said base box structure.

27. The drill rig of claim 24, wherein each base box structure carries at least one support pin and each supported box structure carries at least one support point.

28. The drill rig of claim 24, wherein each base box structure carries at least one support point and each supported box structure carries at least one support pin.

29. The drill rig of claim 24, wherein each base structure carries at least two support pins and each supported box structure carries at least two support points.

30. The drill rig of claim 24, wherein each base structure carries at least two support points and each supported box structure carries at least two support pins.

31. The drill rig of claim 24, wherein each base structure carries at least two hydraulic rams.

32. The drill rig of claim 24, wherein each supported box structure has at least two contact points configured for engagement by said hydraulic rams carried by said base structure.

33. The drill rig of claim 24, wherein each supported box structure carries at least two hydraulic rams and each base box structure has at least two contact points configured for engagement by said hydraulic rams.

34. The drill rig of claim 24, wherein each base box structure has at least one slide pad.

35. A drill rig comprising:

a first master skid and a second master skid, each master skid comprising a base box structure and at least one supported box structure in a pre-assembly configuration said supported box structure is configured to nest over said base box structure prior to assembly of said drill rig;

said first and second master skids positioned a distance apart and secured to one another by bracing;

said supported box structures secured to one another by bracing;

a rig floor supported by said top box structures;

at least one hydraulic ram carried by each base box structure, said ram positioned to engage said supported box structure, said ram configured to lift said supported box structure from a first nested position over said base box structure to an operational position;

at least two support pins carried by each master skid, said support pins moveable from a first position to a second position; and, at least two support points carried by each master skids, whereby each support pin is configured to engage said support point when said support pin is in the second position, engagement of said support point by said support pin retains said supported box structures in the operational position after said supported box structures has been lifted from the nested position to the operational position.

36. The drill rig of claim 35, wherein at least one support pin is carried by said base box structures and at least one support point is carried by said supported box structures.

37. The drill rig of claim 35, wherein each base structure carries at least two hydraulic rams.

38. The drill rig of claim 35, wherein each supported box structure has at least two contact points configured for engagement by said hydraulic rams carried by said base structure.

39. The drill rig of claim 35, wherein each base box structure has at least one slide pad.

40. The drill rig of claim 35, further comprising a starter section of a mast.

41. The drill rig of claim 35, wherein said a portion of said starter section of a mast is nested within each base box structure.

42. The drill rig of claim 35, further comprising mast hydraulics initially carried within said base box structure, said mast hydraulics suitable for raising a mast supported by said drill rig to an operational position.

43. A method of raising a drill rig to an operational height comprising:

positioning first and second master skids a distance apart, said master skids comprising:

a base box structure and at least one supported box structure, arranged in a nested relationship;

at least one hydraulic ram carried by each base box structure, said hydraulic ram positioned to engage said supported box structure, said hydraulic ram configured to lift said supported box structure from said nested position to an operational position;

at least one support pin carried by each master skid, said support pin moveable from a first position to a second position; and, at least one support point carried by each master skid, whereby each support pin is configured to engage said support point when said support pin is in the second position;

securing said master skids to one another with bracing;

actuating said hydraulic rams carried by each base box structure thereby lifting said supported box structure;

moving each support pin carried by each master skid from said first position to said second position;

adjusting the position of said supported box structure such that each support pin engages a support point thereby retaining said supported box structure at said operational height.

44. The method of claim 43, wherein said first and second master skids further comprise mast hydraulics and at least a portion of a starter section of a mast within said base box structures and further comprising the steps:

assembling a mast to said starter section of a mast; and, actuating said mast hydraulics thereby raising said mast to an operational position.

* * * * *